United States Patent [19]

Isaka et al.

[11] Patent Number: 4,949,019

[45] Date of Patent: Aug. 14, 1990

[54] METHOD OF DRIVING THIN FILM EL PANEL FOR AGING

[75] Inventors: Kinichi Isaka, Yamatokoriyama; Hiroyuki Shimoyama, Nara; Toshihiro Ohba, Nara; Hiroshi Kishishita, Nara; Hisashi Uede, Wakayama, all of Japan

[73] Assignee: Sharp Kabushiki Kaisha, Osaka, Japan

[21] Appl. No.: 264,085

[22] Filed: Oct. 28, 1988

[30] Foreign Application Priority Data

Oct. 30, 1987 [JP] Japan ..... 62-274983

[51] Int. Cl.[5] ..... H05B 33/10

[52] U.S. Cl. ..... 315/246; 315/169.3; 445/6

[58] Field of Search ..... 315/169.3, 246; 445/6

[56] References Cited

U.S. PATENT DOCUMENTS 4,412,155 10/1983 Isaka et al. ..... 315/169.3 X 4,818,913 4/1989 Isaka et al. ..... 315/169.3

*Primary Examiner*—Robert J. Pascal

[57] ABSTRACT

An aging drive method for a thin film EL panel includes the performing a preparatory step of short-circuiting all transparent electrodes by a first connecting line, short-circuiting every other metal electrodes by a second connecting line and short-circuiting the other metal electrodes by a third connecting line. Thereafter four fields are repeatedly periodically executed for a specified period of time to thereby cause all picture elements of the panel to luminesce for aging. Each of the four fields includes a first step of applying a first voltage across the first and second connecting lines and across the first and third connecting lines to charge all the picture elements. Further a second step is included of applying a second voltage across the second and third connecting lines while holding the transparent electrodes in a floating state. This causes luminescence of the picture elements of the metal electrodes short-circuited by the second or third connecting line, with the voltage resulting from the charge on the picture elements stored in the first step and with the second voltage. The four fields are different from one another in the combination of the polarities of the first and second voltages.

10 Claims, 3 Drawing Sheets

METHOD OF DRIVING THIN FILM EL PANEL FOR AGING

BACKGROUND OF THE INVENTION

1. Field of the Invention

The present invention relates to an aging drive method for thin film EL panels which includes a group of transparent electrodes, a group of metal electrodes disposed thereover and extending in a direction so as to intersect the group of transparent electrodes, and an EL emitting layer interposed between the two groups of electrodes to provide picture elements at the respective intersections. The method is especially useful for thin film EL panels of a large area.

2. Description of the Prior Art

Thin film EL panels are generally aged for a specified period of time following the preparation of the thin film by applying an alternating voltage to the picture elements positioned at the intersections of a group of transparent electrodes and a group of metal electrodes, for example. This is done to stabilize the variations in the luminescence brightness, etc. which occur with time and further to reject a faulty device due to an initial malfunction.

As disclosed in U.S. Pat. No. 4,412,155 granted to the present applicant and in U.S. Patent Application Ser. No. 06/401,385 filed on July 23, 1982 by the present applicant and now U.S. Pat. No. 4,818,913, the EL panel is aged by applying alternating voltage pulses across the group of transparent electrodes, which are all short-circuited, and the group of metal electrodes, which are all shortcircuited, to cause all the picture elements to luminesce simultaneously. Further, the procedure is repeated over a specified period of time.

However, when the above aging method is used for a thin film EL panel having a large area, the waveform of the alternating voltage pulses applied to the picture element involves a time lag which is needed for the voltage to reach a definite level, i.e. so-called waveform rounding. This owes to the time constant which is dependent on the resistance of the transparent electrode, and the capacitance of the picture element. The method is therefore unable to age all the picture elements uniformly.

This problem can be overcome by dividing the metal electrodes, which are arranged in parallel, into a group of odd-numbered electrodes and a group of even-numbered electrodes, and applying a voltage across the two groups.

This method is free from the influence of a time constant due to the resistance of the transparent electrodes. This is because the picture elements of the group of odd-numbered metal electrodes are connected in series with the picture elements of the other group, through the transparent electrodes.

Nevertheless, if a dielectric breakdown occurs in a small number of picture elements during this method, a voltage drop at the faulty picture elements is added to the other faultless picture elements. This results in great voltage pulse exceeding the voltage pulse needed for aging being applied to the faultless picture elements to induce a further dielectric breakdown. This is because the group of faulty picture elements is connected in series with the group of faultless picture elements.

SUMMARY OF THE INVENTION

The present invention provides an aging drive method for a thin film EL panel including a group of transparent electrodes, a group of metal electrodes disposed thereover and extending in a direction intersecting the group of transparent electrodes, and an EL emitting layer interposed between the two groups of electrodes to provide picture elements at the respective. It also includes performing a preparatory step of short-circuiting all the transparent electrodes by a first conductor, short-circuiting every other metal electrode by a second conductor and short-circuiting the other metal electrodes by a third conductor, and thereafter repeatedly performing four main steps periodically for a specified period of time to thereby cause all the picture elements to luminesce for aging, each of the four main steps comprising in combination a first step of applying a first voltage across the first conductor and the second conductor and across the first conductor and the third conductor to charge all the picture elements, and a second step of applying a second voltage across the second conductor and the third conductor while holding the transparent electrodes in a floating state to cause luminescence of the picture elements of the metal electrodes short-circuited by the second conductor or the third conductor with the voltage resulting from the charge on the picture elements stored in the first step and with the second voltage, the four main steps being different from one another in the combination of the polarities of the first and second voltages.

With the aging drive method of the invention described above, the picture elements of the metal electrodes short-circuited by the second conductor or the third conductor are caused to luminesce with the voltage resulting from the charge accumulated on the picture elements in the first step, so that the amount of current through the transparent electrodes is smaller than in the prior art to diminish the influence of the time constant. This renders the present method usable for thin film EL panels of large capacity. Moreover, the first and second voltages can be lower than conventional systems, resulting in the fact that even if luminescent picture elements undergo a minute dielectric breakdown to cause a marked voltage drop, an abnormal voltage will not be applied to the other picture elements. Thus, dielectric breakdown will be induced in the other picture elements.

DESCRIPTION OF THE PREFERRED EMBODIMENTS

Figure 1:
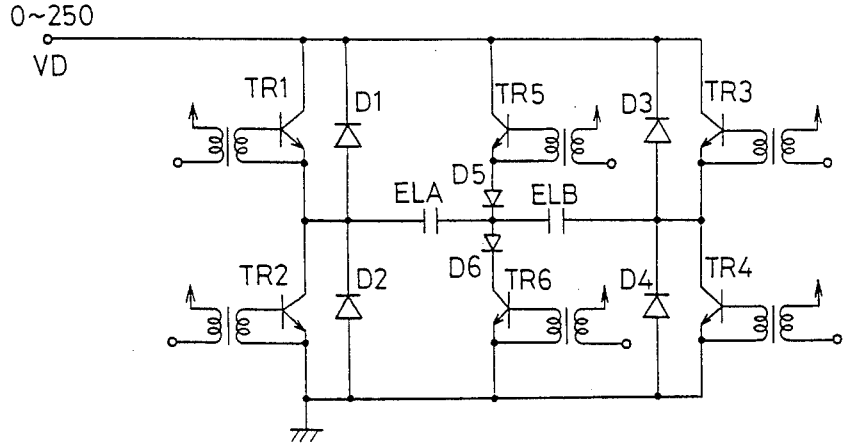
FIG. 1 is a diagram showing a circuit construction embodying the invention.

The first conductor, the second conductor and the third conductor to be used in the aging drive method of the present invention are known connecting lines of low resistance which are capable of electrically connecting the transparent electrodes and metal electrodes.

The method of the invention consists essentially of a preparatory step, and main steps which are performed after the preparatory step. The preparatory step is an electrode connecting process required for applying voltage to the transparent electrodes and the metal electrodes. In the main steps, voltage is actually applied to the transparent electrodes and the metal electrodes. Since the voltage application condition differs from step to step, these main steps will be referred to as "fields" in the following description of embodiments.

The present invention will be described below in detail with reference to the embodiments shown in the drawings.

Figure 5:
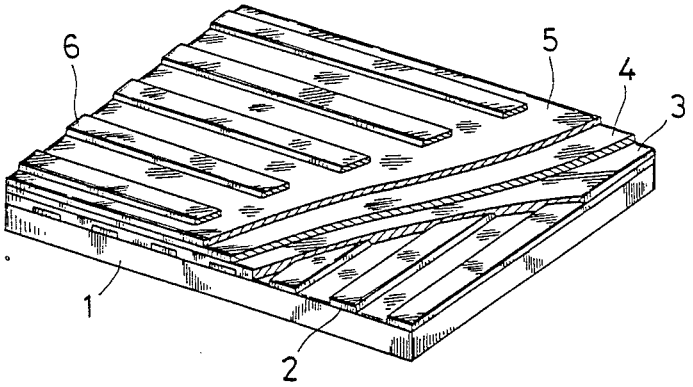
FIG. 5 is a diagram illustrating the structure of an example of thin film EL panel to which the invention is applied.

FIG. 5 is a perspective view, partly broken away, and showing a thin film EL display panel of double insulation film structure to which the aging drive method of the invention is applied.

With reference to FIG. 5, the panel includes a multiplicity of transparent strip electrodes 2, for example, of ITO arranged in parallel as a group and formed on a glass substrate 1. It further includes a dielectric layer 3 as of $Si_3N_4$, an EL emitting layer 4 of ZnS doped with Mn or like active agent, and a dielectric layer 5 as of $Si_3N_4$. These layers are formed over the group of transparent electrodes 2, for example, by vacuum evaporation or sputtering as a three-layer structure. The panel further includes a group of metal electrodes 6 of Al or like metal formed on the dielectric layer 5 and extending in a direction intersecting the transparent electrodes 2 at right angles therewith. The panel is equivalent to a capacitance device. When a specified alternating voltage is applied across a desired transparent electrode and a desired metal electrode, a portion of minute area held between the two electrodes at their intersection luminesces. This thus provides a picture element for displaying characters, symbols, patterns or the like.

Figure 6:
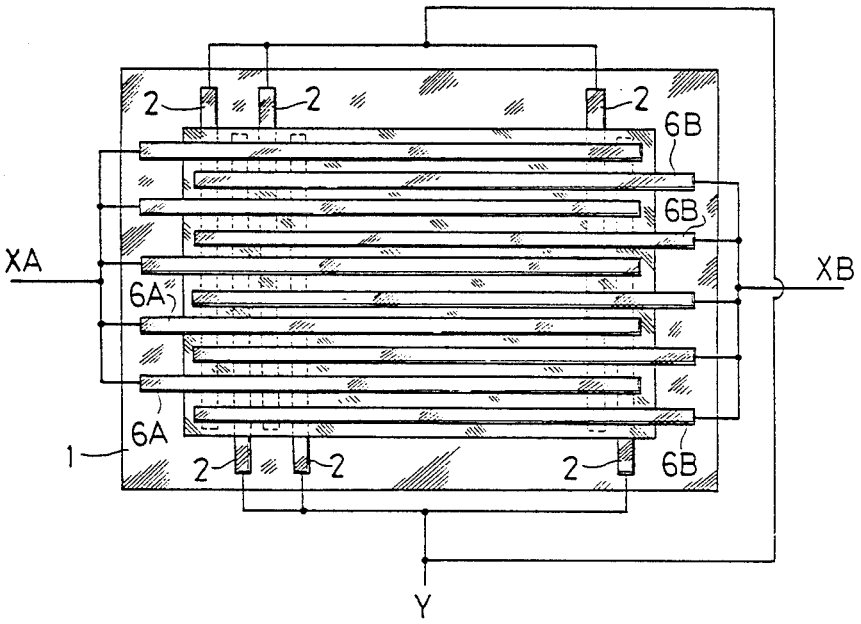
FIG. 6 is a diagram showing how electrodes are connected for practicing the aging drive method of the invention.

FIG. 6 is a plan view showing how the electrodes are connected according to the aging drive method of the invention.

With reference to the drawing, the electrodes are connected in the following manner as a preparatory step according to the invention. The transparent electrodes 2, 2, . . . are all short-circuited by a connecting line Y. The metal electrodes 6 are divided into two groups, i.e., odd-numbered electrodes 6A, 6A, . . . and even-numbered electrodes 6B, 6B, . . . . The odd-numbered metal electrodes 6A, 6A, . . . are all short-circuited by a connecting line XA, and the even-numbered metal electrodes 6B, 6B,. . . are all short-circuited by a connecting line XB.

FIG. 1 shows the construction of an aging drive circuit for performing the main steps of the present method. With reference to the drawing, indicated at ELA are the picture elements of the EL panel provided by the odd-numbered metal electrodes 6A, 6A,. . . and the transparent electrodes 2, 2, . . . . Further, at ELB are the picture elements of the panel provided by the even-numbered metal electrodes 6B, 6B. . . and the transparent electrodes 2, 2,. . . . The circuit has switching transistors TR1 to TR6 and diodes D1 to D6.

According to the present embodiment, the aging drive method includes a first to a fourth field. In the first field, a first voltage VD of positive polarity lower than luminescence start voltage is applied across the odd-numbered metal electrodes 6A, 6A, . . and the transparent electrodes 2, 2, . . . and across the even-numbered metal electrodes 6B, 6B, . . . and the transparent electrodes 2, 2, . . . . Subsequently, a second voltage VD is applied across the odd-numbered metal electrodes 6A, 6A, . . . and the even-numbered metal electrodes 6B, 6B, . . . while holding the transparent electrodes 2, 2, . . . in a floating state so as to cause the picture elements ELA to luminesce by the application of voltage of positive polarity to the transparent electrodes. In the second field, the first voltage VD of positive polarity is applied across the odd-numbered metal electrodes 6A, 6A, . . . and the transparent electrodes 2, 2 . . . and across the even-numbered metal electrodes 6B, 6B, . . . and the transparent electrodes 2, 2, . . . . Subsequently, the second voltage VD is applied across the even-numbered metal electrodes 6B, 6B, . . . and the odd-numbered metal electrodes 6A, 6A, . . . while holding the transparent electrodes 2, 2 . . . in a floating state so as to cause the picture elements ELB to luminesce by the application of voltage of positive polarity to the transparent electrodes. In the third field, the first and second voltages are opposite in polarity to those in the first field so as to cause the picture elements ELA to luminesce by the application of voltage of negative polarity. In the fourth field, the first and second voltages are opposite in polarity to those in the second field so as to cause the picture elements ELB to luminesce by the application of voltage of negative polarity. These four fields are repeated periodically for a specified period of time. The operation of the circuit in these fields will be described below.

Figure 2:
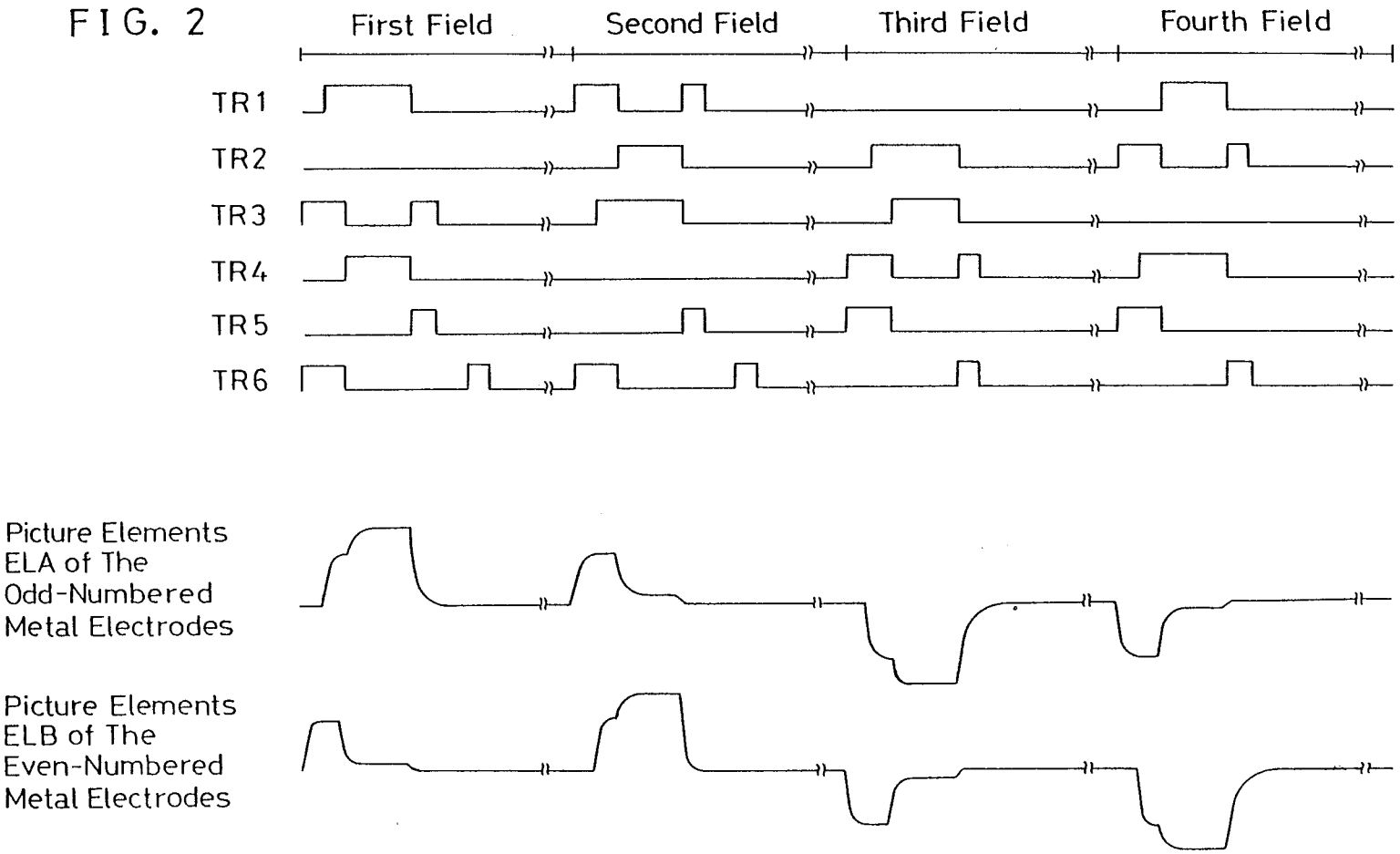
FIG. 2 is a timing chart of the embodiment of FIG. 1.

FIG. 2 shows the timing chart of the switching transistors TR1 to TR6 and the waveforms of voltages applied to the picture elements ELA of the odd-numbered metal electrodes and the picture elements ELB of the even-numbered metal electrodes.

First Field

Figure 3:
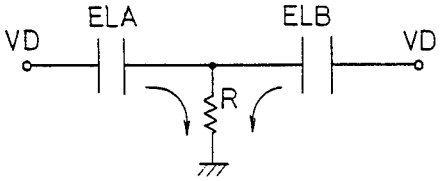
FIGS. 3 and 4 are diagrams showing equivalent circuits of the embodiment of the invention.

First, the switching transistors TR6 and TR3 are brought into conduction. Then, the switching transistor TR1 is brought into conduction, whereby charge C.VD is stored on the picture elements ELA and the picture elements ELB. FIG. 3 shows a circuit equivalent to the drive circuit at this time. The transistor TR1 is thus turned on slightly after the transistor TR3. This is to diminish the voltage drop due to the current through the transparent electrodes.

Next, the transistor TR6 and the transistor TR3 are brought out of conduction, and the transistor TR4 is brought into conduction to reduce the voltage on the metal electrodes for the picture elements ELB to 0 V. Consequently, owing to the capacitive coupling between the picture elements ELA and the picture elements ELB, the potential on the transparent electrodes becomes $-\alpha \cdot VD$, thus a voltage of $(1+\alpha) \cdot VD$ is applied to the picture elements ELA. Since this voltage is not lower than the luminescence threshold voltage, the picture elements ELA luminesce.

Figure 4:
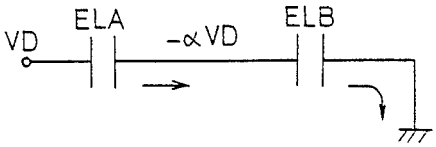

On the other hand, the voltage applied to the picture elements ELB is $\alpha \cdot VD$ and is lower than the luminescence threshold value, thus the picture elements ELB do not luminesce. FIG. 4 shows a circuit equivalent to the drive circuit at this time.

The value $\alpha$ is dependent upon the magnitude of voltage VD and is determined by the following calculation.

With reference to FIG. 3, the charges QA, QB on the respective picture elements ELA, ELB are $$QA = QB = C \cdot VD \quad (1)$$

wherein C is the capacitance of the picture elements ELA, ELB not luminescing.

Similarly, with reference to FIG. 4, the charges Q'A, Q'B on the picture elements ELA, ELB are $$Q'A=C'\cdot[VD=(-\alpha\cdot VD)]=(1+\alpha)\cdot C'\cdot VD \quad (2)$$

$$Q'B=C\cdot[0-(-\alpha\cdot VD)]=\alpha\cdot C\cdot VD \quad (3)$$

wherein C' is the capacitance of the picture element ELA when it is luminescent.

The amount of charge transferred from the picture elements ELA, ELB in FIG. 3 to the picture elements ELA, ELB in FIG. 4 is given by $$\Delta Q=Q'A-QA=-(Q'B-QB) \quad (4)$$

since the picture element ELA and the picture elements ELB are opposite in the polarity of transfer charge but equal in the amount of thereof.

Substitution of Equation (4) in Equations (1) to (3) gives $$(1+\alpha)\cdot C'-C=-(\alpha\cdot C-C)\cdot$$

Accordingly, $\alpha$ is given by $$\alpha=(2C-C')/(C+C')\cdot$$

When the voltage VD is too low to cause luminescence, $\alpha$ is 0.5, but is smaller than 0.5 in luminescent state. When the luminescence threshold voltage of the picture element is assumed to be Vth, the picture element luminesces if the voltage VD is at least (170 )·Vth.

If the picture element ELA, for example, undergoes a minute dielectric breakdown to result in an abrupt voltage drop in this case, a voltage exceeding ±VD is not applied to the picture element ELB since the voltage across the picture elements ELA and ELB is VD. Consequently there is no likelihood that an dielectric breakdown will be induced in the picture element ELB.

In the second step, i.e. in the state of FIG. 4, the transistor TR6 is out of conduction, this the luminescence current does not flow through the transparent electrodes and is therefore free of the influence of the electrode resistance R. Accordingly, even if used for EL panels of large area, the present method is free of the objection that the waveform of the applied voltage will be altered by the time constant.

Second Field

First, the transistors TR6 and TR1 are brought into conduction. Then the transistor TR3 is brought into conduction, whereby charge C·VD is stored on the picture elements ELA and ELB.

Next, the transistors TR6 and TR1 are brought out of conduction, and the transistor TR2 is brought into conduction to reduce the voltage on the metal electrodes for the picture elements ELA to 0 V. Consequently, owing to the capacitive coupling between the picture elements ELA and the picture elements ELB, the potential on the transparent electrodes becomes $-\alpha\cdot$VD, with the result that a voltage of $(1+\alpha)\cdot$VD is applied to the picture elements ELB. Since this voltage is not lower than the luminescence threshold voltage, the picture elements ELB luminesce.

On the other hand, the voltage applied to the picture elements ELA is $\alpha\cdot$VD and is lower than the luminescence threshold value, thus the picture elements ELA do not luminesce.

Third Field

First, the transistors TR5 and TR4 are brought into conduction. Then the transistor TR2 is brought into conduction, whereby charge −C·VD is stored on the picture elements ELA and ELB.

Next, the transistors TR5 and TR4 are brought out of conduction, and the transistor TR3 is brought into conduction to raise the voltage on the metal electrodes for the picture elements ELB to VD. Consequently, owing to the capacitive coupling between the picture elements ELA and the picture elements ELB, the potential on the transparent electrodes becomes $(1+\alpha)\cdot$VD. This results in a voltage of $-(1+\alpha)\cdot$VD being applied to the picture elements ELA, causing these elements to luminesce. On the other hand, the voltage applied to the picture elements ELB is $-\alpha\cdot$VD and thus does not cause luminescence of these elements ELB.

Fourth Field

First, the transistors TR5 and TR2 are brought into conduction. Then the transistor TR4 is then brought into conduction, whereby charge −C·VD is stored on the picture elements ELA and ELB.

Next, the transistors TR5 and TR2 are brought out of conduction, and the transistor TR1 is brought into conduction to raise the voltage on the metal electrodes for the picture elements ELA to VD. Consequently, owing to the capacitive coupling between the picture elements ELA and the picture elements ELB, the potential on the transparent electrodes becomes $(1+\alpha)\cdot$VD. This results in a voltage of $-(1+\alpha)\cdot$VD being applied to the picture elements ELB, thus causing these elements to luminesce. On the other hand, the voltage applied to the picture elements ELA is $-\alpha\cdot$VD and thus does not cause luminescence of these elements ELA.

The four fields of the embodiment described above, which are repeated periodically for a specified period of time, include the first field wherein voltage of positive polarity is applied to the transparent electrodes to cause the luminescence of the picture elements ELA. The second field is included wherein voltage of positive polarity is applied to the transparent electrodes to cause the luminescence of the picture elements ELB. Further, the third field is included wherein the application of voltage of negative polarity causes the luminescence of the picture elements ELA. Finally, the fourth field is included wherein the application of voltage of negative polarity effects the luminescence of the picture elements. The combination of these four fields can be different. For example, the first field may be followed by the second, fourth and third fields in this order, or by the third, second and fourth fields. Further, the first field may be followed by the third, fourth and second fields, or by the fourth, second and third fields, or even by the fourth, third and second fields, in the order mentioned.

Thus, the four fields which differ from one another, in the combination of the polarities of the first voltage VD and the second voltage VD, are executed repeatedly for a specified period of time.

With the aging drive method of the invention for thin film EL panels, current flows through the transparent electrodes to charge the picture elements, but the luminescence current for causing the luminescence of the picture elements flows from metal electrodes to metal electrodes through the transparent electrodes. Thus, the amount of current through the transparent electrodes can be much smaller than in the conventional aging drive method wherein voltage is applied across the transparent electrodes and the metal electrodes. As a result, the EL panel can be driven for aging with reduced variations in the drive current due to the influence of the transparent electrode resistance and with diminished waveform rounding of the applied current due to the influence of the time constant. This assures an improved aging efficiency and makes the present method usable for aging EL display panels of large area.

Further since the charge on the nonluminescent picture elements is utilized for the application of voltage to the picture elements to be luminesced, the voltage to be applied from an external source can be lower than the voltage actually applied for the luminescence of picture elements. Accordingly, even if some luminescent picture elements undergo a minute dielectric breakdown to result in an abrupt voltage drop, no abnormal voltage will be applied to the other picture elements. Thus, they can therefore be protected from an induced dielectric breakdown.

Because the aging drive method of the invention can be practiced with a diminished influence of the electrode resistance, without inducing an dielectric breakdown by a circuit of simple construction, the method is useful for an apparatus for aging of large sized EL panels for mass-production.

What is claimed is:

1. An aging drive method for a thin film EL panel which includes a group of transparent electrodes, a group of metal electrodes disposed thereover and extending in a direction intersecting the group of transparent electrodes, and an EL emitting layer interposed between the two groups of electrodes to provide picture elements at the respective intersections, the method comprising the steps of:

performing a preparatory step of short-circuiting all the transparent electrodes by a first conductor, short circuiting every other metal electrode in an alternating manner by a second conductor and short-circuiting the remaining metal electrodes by a third conductor; and performing four main steps periodically and repeatedly for a predetermined period of time to thereby cause all the picture elements to luminesce for aging, each of the four main steps including, in combination, applying a first voltage, in a first step, across the first conductor and the second conductor and across the first conductor and the third conductor to charge all the picture elements, and a second step of applying a second voltage, in a second step, across the second conductor and the third conductor, while maintaining the transparent electrodes in a floating state so as to cause luminescence of the picture elements of the metal electrodes short-circuited by the second conductor or the third conductor with the voltage resulting from the charge on the picture elements stored in the first step and with the second voltage, wherein the four main steps are different from one another in a combination of the first and second voltages of different polarities.

2. A method as defined in claim 1, wherein the four main steps are:

a first main step wherein the first and second voltages are positive, a second main step wherein the first voltage is positive and the second voltage is negative, a third main step wherein the first and second voltages are negative, and a fourth main step wherein the first voltage is negative and the second voltage is positive.

3. A method as defined in claim 1, wherein the four main steps are:

a first main step wherein the first and second voltages are positive, a second main step wherein the first voltage is positive and the second voltage is negative, a third main step wherein the first voltage is negative and the second voltage is positive, and a fourth main step wherein the first and second voltages are negative.

4. A method as defined in claim 1, wherein the four main steps are:

a first main step wherein the first and second voltages are positive, a second main step wherein the first and second voltages are negative, a third main step wherein the first voltage is positive and the second voltage is negative, and a fourth main step wherein the first voltage is negative and the second voltage is positive.

5. A method as defined in claim 1, wherein the four main steps are:

a first main step wherein the first and second voltages are positive, a second main step wherein the first and second voltages are negative, a third main step wherein the first voltage is negative and the second voltage is positive, and a fourth main step wherein the first voltage is positive and the second voltage is negative.

6. A method as defined in claim 1, wherein the four main steps are:

a first main step wherein the first and second voltages are positive, a second main step wherein the first voltage is negative and the second voltage is positive, a third step wherein the first voltage is positive and the second voltage is negative, and a fourth main step wherein the first and second voltages are negative.

7. A method as defined in claim 1, wherein the four main steps are:

a first main step wherein the first and second voltages are positive, a second main step wherein the first voltage is negative and the second voltage is positive, a third main step wherein the first and second voltages are negative, and a fourth main step wherein the first voltage is positive and the second voltage is negative.

8. A method as defined in claim 1, wherein the first and second voltages are equal in the absolute value of the magnitude.

9. A method as defined in claim 1, wherein the first and second voltages are not greater in magnitude than the absolute value of the luminescence threshold voltage of the picture elements.

10. A method as defined in claim 1, wherein the first and second voltages are not less in magnitude than $\frac{2}{3}$ of the absolute value of the luminescence threshold voltage of the picture elements.

* * * * *